United States Patent [19]

Berry et al.

[11] 4,301,997

[45] Nov. 24, 1981

[54] CONTINUOUS COPPER MELTING FURNACE

[75] Inventors: Milton E. Berry; Ronald L. Pariani, both of Carrollton, Ga.

[73] Assignee: Southwire Company, Carrollton, Ga.

[21] Appl. No.: 921,038

[22] Filed: Jun. 30, 1978

[51] Int. Cl.[3] ..... C21C 5/42

[52] U.S. Cl. ..... 266/236; 75/44 R; 75/72; 266/218

[58] Field of Search ..... 75/44 R, 44 S, 72–76, 75/41–42; 266/218, 236

[56] References Cited

U.S. PATENT DOCUMENTS

| | | | |
|---|---|---|---|
| 3,547,624 | 12/1970 | Gray | 75/42 |
| 3,833,356 | 9/1974 | Luth | 75/42 |
| 3,837,840 | 9/1974 | Poos | 75/42 |
| 3,884,677 | 5/1975 | Wenzel | 75/42 |
| 3,892,517 | 7/1975 | Ebeling | 75/42 |

*Primary Examiner*—P. D. Rosenberg

*Attorney, Agent, or Firm*—Herbert M. Hanegan; Stanley L. Tate; Robert Steven Linne

[57] ABSTRACT

An improved vertical furnace for melting metal pieces, such as pieces of copper cathode. The furnace has a generally round interior wall of refractory brick material which encloses a vertical melting chamber having a plurality of burner openings through the refractory wall. Heat, being injected through these openings by means of a novel burner design, melts the metal pieces under metallurgically controlled conditions. The burners are arranged near the bottom floor of the melting chamber which is sloped toward a single outlet thus allowing the molten metal to continuously drain from the melting chamber. The burners are fed a mixture of fuel and air from a plurality of remote mixing stations so as to reduce turbulence at the burners thereby significantly reducing the operating noise level and refractory wear compared to prior art furnaces. A combustion chamber between the burner and the melting chamber is provided so as to prevent entry of uncombusted fuel and/or air, thereby maintaining the closely controlled atmosphere in the melting chamber.

18 Claims, 4 Drawing Figures

CONTINUOUS COPPER MELTING FURNACE

BACKGROUND OF THE INVENTION

1. Field of the Invention

This invention relates to an improved vertical shaft type furnace construction, and burner design for use therein, which is particularly useful for continuously melting copper pieces such as cathodes.

2. Prior Art

Vertical gas-fired shaft type furnaces for melting metal, such as copper, are well known in the art. Examples of such furnaces are seen in: U.S. Pat. Nos. 3,199,977; 3,701,517; 3,715,203; 3,788,623; and in the prior art patents cited in each of them.

Generally these furnaces have a substantially cylindrical shape and are elongated in a vertical direction. The metal to be melted, such as copper cathode pieces having a low oxide content, is charged into the furnace from an elevated position. The metal drops toward the bottom of the furnace, where a plurality of burners inject hot gases into the melting chamber to cause the metal to melt. The molten metal is drained from the furnace by a suitable outlet near the bottom in order to continuously supply the molten metal to a holding furnace or to a casting operation.

The burners are usually arranged in one or more rows surrounding the lower portion of the furnace, in order to define a melting chamber, and are directly affixed into the furnace walls. Each of a plurality of burners, all fed fuel from one common source, injects a fuel and air mixture into a melting chamber causing a highly turbulent flame to impinge on that metal directly adjacent each burner. Refractory tunnel type burners are known in the art as means for supplying a high temperature blast to a furnace. Typically, the throat mix type of burner is used in the prior art furnaces since they do not experience some of the problems common to a premix type burner such as backfires in the supply manifolds or flameouts, that is, isolation of the flame from the combustion ports. However, the throat mix burners of the prior art have disadvantages also. Throat mix burners must have a very turbulent high velocity flame to ensure adequate mixing of the fuel and air in the short space allotted within the burner. This results in a high operating noise level and very severe service conditions which deteriorate the furnace and burner refractories. When the deterioration reaches a certain state the operating efficiency of the burner and furnace is so adversely affected that reconditioning is required. Specifically, the deterioration has resulted from spalling, slagging, abrasion, or some combination of these. Spalling may be defined as the physical break-down or deformation or crushing of the refractory attributed to thermal or mechanical or structural causes. Slagging is the destructive action that occurs in the refractory due to chemical reactions occuring at the elevated temperatures involved. Abrasion is considered to be the deterioration of the refractory surfaces by the scouring action of solids moving in contact therewith. The solids may be carried by or formed in the combustion gases.

It is generally considered that in the most efficient types of refractory tunnel burners the refractory has good insulting properties, high heat resistance, and a rough interior surface texture. After the burner is lighted the refractory is heated and thereafter serves to maintain ignition. The roughness of the refractory surface causes the gases flowing adjacent thereto to be slightly turbulent and therefore exert a catalytic effect upon and consequently accelerate the combustion process. However, refractories which have good insulating properties and a rough surface also tend to have less resistance to the abrasive effects of the high velocity combustion gases and therefore experience much faster wear than a more dense, smooth refractory, such as silicon carbide. Another disadvantage of prior art burner arrangements is that when the combustion products are not properly mixed within the burner and before entering the furnace they have an uneven, unpredictable effect on the melting process, especially when operated over a varying range of melting rates which is necessary when supplying molten copper to a variable rate continuous casting system.

In summary, the main problem heretofore encountered with the prior art vertical furnace and burner combinations is that it is sometimes metallurgically unsuccessful when adapted to melt copper cathodes and is used to supply molten copper to a continuous casting and rolling process which is intending to produce electrical conductor grade copper bars. Part of the problem is that the molten copper becomes contaminated with unacceptable amounts of impurities. For example, oxygen and sulphur which are easily introduced into the molten metal from the combustion process, have a detrimental effect on the subsequent rolling of the cast copper into bars. Also, slags and metallic contaminants can be introduced into the melt which thereafter have a detrimental effect on the quality or conductivity of the final product. Thus, although vertical furnaces and various types of burners are well known in the art, significant needed improvements therein have been made by the present invention.

GENERAL DISCUSSION OF THE INVENTION

It is therefore the main object of this invention to provide an improved vertical furnace and burner structure which is suitable for continuously melting copper and which substantially avoids some disadvantages of prior art furnaces and burners. Another object of the invention is to improve the chemical composition of the product and render the same to more exact control, by increasing the uniformity and predictability of the process. It is another object of this invention to provide an improved refractory tunnel burner in which the combustion of a premixed combustible gas mixture and the operational efficiencies are enhanced and also providing a relatively low operating noise level with good service life.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which:

DESCRIPTION OF THE PREFERRED EMBODIMENT

The vertical melting furnace and burner apparatus of the invention is comprised of the major parts: a refractory lined furnace, rows of burners situated around the furnace's lower circumference, manifolds supplying a fuel and air mixture to the burners, and mixers for forming and regulating the combustible mixture.

Figure 1:
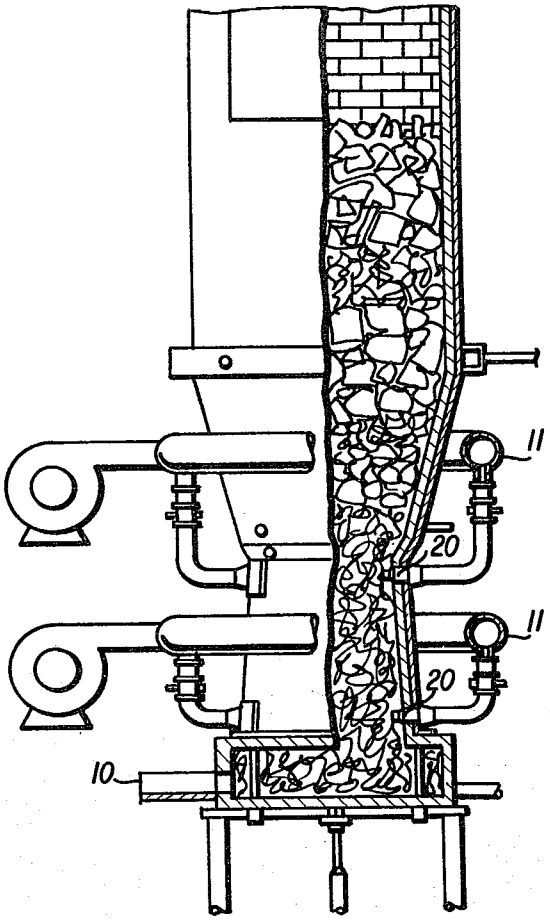
FIG. 1 is a partial elevational view of a vertical shaft furnace useful for melting pieces of metal.
Figure 2:
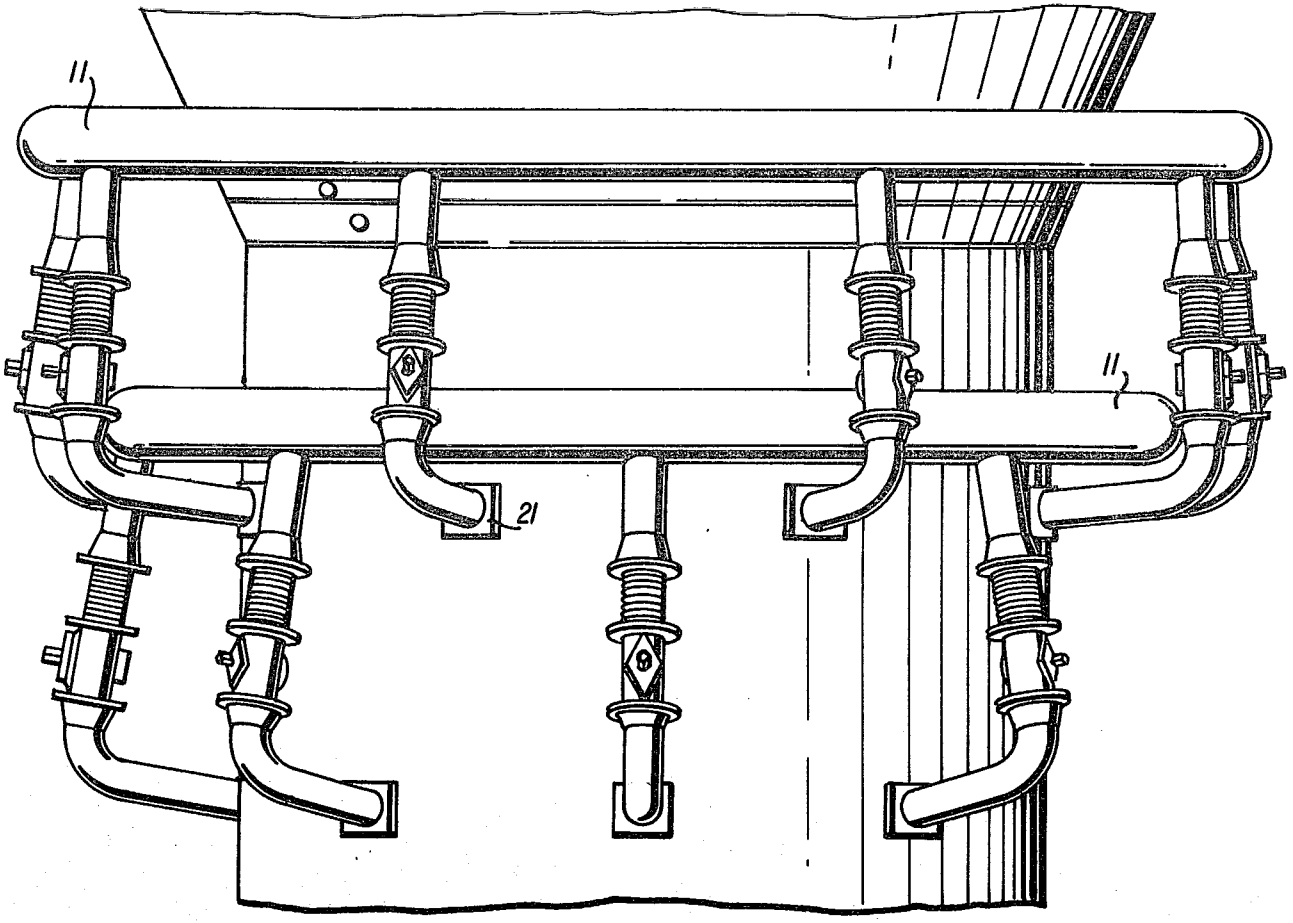
FIG. 2 is an enlarged exterior view of the lower portion of the furnace showing the fuel/air manifolds in communication with the burners.

The furnace of FIG. 1 is vertically elongated, the upper end being open to receive the metal loaded for melting and the bottom end closed forming the furnace floor. The outer metallic wall supports and controls the inner wall which is of a refractory material, such as fire brick, capable of withstanding the temperatures involved in melting copper, for example, and defines the cylindrical melting chamber.

The furnace floor is a "V" shaped trough formed of a refractory material and is inclined such that the molten metal flows by gravity down the sides of the trough and down the trough incline to the lowest point on the furnace floor, where a tap hole 10 is located to drain off the molten metal.

Two or more rows of eight burners substantially are equispaced on the furnace circumference. They communicate with the melting chamber through ports 20 piercing both walls and melt the metal within by direct contact with the streams of hot gases from the novel burners. The burners are affixed to the outer containment by bolting 21 or welding or other means. Their longitudinal axes are inclined at a slight angle from the horizontal and intersect the furnace longitudinal centerline, the lower row of burners being situated such that the bottoms of their refractory tiles are just above the furnace floor. In this configuration the hot products of combustion expelled by the bottom row of burners continuously wash the furnace floor clean of frozen metal and slag.

Figure 3A:
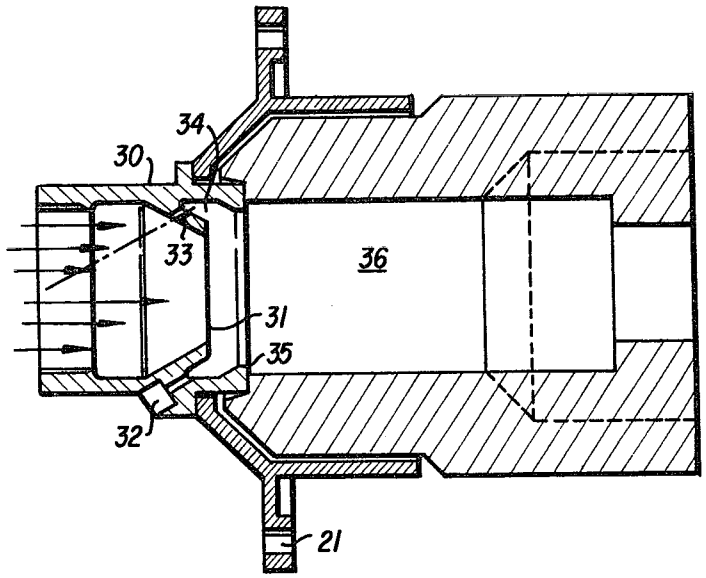
FIG. 3A is a longititudinal sectional view of one burner assembly showing the nozzle mounted to the refractory combustion chamber.
Figure 3B:
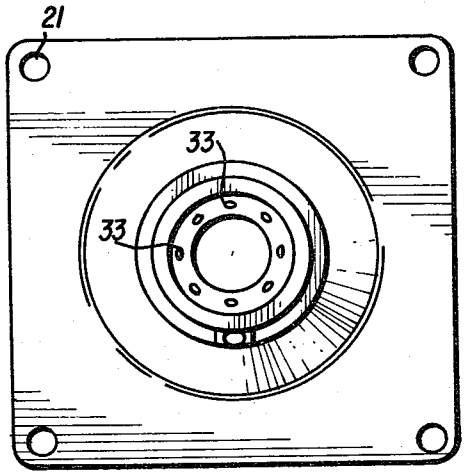
FIG. 3B is an end view of the burner nozzle as seen from the hot side.

FIG. 3A shows a flame retention burner of the invention in section. A combustible gaseous fuel and air mixture enters nozzle body 30 under pressure. Nozzle 31 delivers the mixture, ignited by sparkplug 32 or other means, to the combustion chamber and is adapted to avoid backfire into the supply. An annular series of holes 33 formed through the nozzle lip communicates with the cutaway space 34 surrounding the nozzle end downstream and serve to retain the flame at the nozzle. The lip 35 extending from the cutaway outside diameter to the point where the nozzle body necks up to the slightly greater diameter of the combustion chamber 36 adapted to contain flames of high velocity.

The combustion chamber 36 is advantageously cylindrical and straight in size or restricted, formed of refractory tile and allowing substantially complete combustion of the fuel and air mixture such that essentially only products of combustion exit it to contact the metal in the melting chamber. The refractory tile enhances combustion and gives the mixture time to burn completely, allowing greater control over combustion products entering the furnace and making the melting process uniform and predictable, particularly when a wide range of melting rates is required.

Due to the fact that no mixing of fuel and air occurs in the burner structure, the burner of the invention is simple in design and produces a less turbulent flame than the usual throat mix burner, there being no extra turbulence induced at the burner to mix the fuel with air. The lack of mixing turbulence results in two improvements: quieter operation, as the turbulent mixing component of the operational noise is not present, and less refractory wear because the burner output is a flame of less turbulence.

Manifolds 11 deliver the premixed fuel and air to the burners, arranged so that there are relatively few burners per manifold—4 burners per manifold is the preferred embodiment—to prevent flashback into the air and fuel mixture. To increase furnace size more manifolds and burners in the above numerical relation must be added.

A mixing station (not shown) is provided for each manifold. A suitable design is that of a venturi mixer, well known in the prior art (for example U.S. Pat. No. 3,799,195), wherein mixing is accomplished when air under pressure passes through a venturi and fuel is injected into the air stream at the low pressure in the venturi throat. Mixture proportioning is set by proportional inline orifices or valves in the fuel and air supply lines preferably in conjunction with orifice flow measuring equipment, all well known in the art. A most suitable method of controlling the fuel mixture is disclosed in U.S. Pat. No. 4,239,191 assigned to the assignee of the present invention which is incorporated herein by reference.

In the preferred embodiment, the furnace operates under slightly reducing conditions, i.e., 5 to 10 percent excess fuel over stochiometric, as adjusted by the mixers. Due to the fact that the burner design allows essentially complete combustion within the combustion chamber, the melting chamber atmosphere can be closely maintained in the reducing state, avoiding the introduction of excess oxygen to the copper therein.

Without further analysis, we believe the foregoing will fully reveal the essence of the present invention so that others can, by applying current knowledge or reasonable experimentation, readily adapt it for various applications without omitting features that, from the standpoint of prior art, fairly constitute essential characteristics of the generic or specific aspects of this invention and, therefore, such adaptations should and are intended to be comprehended within the meaning and scope of equivalence of the following claims.

What is claimed is:

1. In a vertical shaft furnace for continuously melting pieces of copper metal, said furnace being of the type having a refractory lined wall enclosing a melting chamber, a plurality of burners affixed to said wall for injecting heat into said metal pieces, and an outlet in the bottom of said chamber for continuously discharging molten copper, the improvement comprising:

(a) a plurality of mixing means for variably combining fuel and air remotely from the burners;

(b) a plurality of manifold means for delivery of said fuel and air mixture to (c) means for burning a premixed combustible gaseous mixture of fuel and air comprising a plurality of refractory tunnel burners of the flame retention type wherein said burners include a refractory tile combustion chamber of generally cylindrical cross-section; and (d) wherein each manifold means supplies relatively few burners, said arrangement comprising anti-backfire means; and (e) wherein the proportion of the mixing means to the aforesaid manifold means is one mixer means per manifold means.

2. The apparatus of claim 1 wherein the proportion of burners per manifold is four burners per manifold.

3. The apparatus of claim 2 wherein said mixing means comprises a venturi restriction in an air supply, means for introducing fuel into said air supply at the throat of said venturi, means for proportioning said air and fuel prior to mixing comprising variable proportional orifices in air and fuel supply lines, and means for monitoring said mixture proportions comprising orifice flow measuring means attached at said supply line orifices, and further comprising means for controlling melting chamber atmosphere comprising:

(a) means for calculating, for the fuel in use, the stochiometric fuel/air ratio;

(b) means for measuring the fuel/air ratio upstream of said mixing means with said orifice flow measuring means;

(c) means for adjusting the fuel/air ratio by varying said orifices until a mixture of 0.5 to 10 percent excess fuel over the stochiometric ratio is achieved.

4. The apparatus of claim 3 wherein the basis of said refractory burner's combustion chambers are restricted constituting means to retain the combustion and enhance complete combustion.

5. The apparatus of claim 2 wherein means for washing the furnace floor clean of frozen copper and slag is included, comprising the placement of the lower row of burners at a position where the bottom edges of said combustion chambers are at or just above the furnace floor.

6. The apparatus of claim 5 wherein said furnace floor is comprised of a "V" shaped trough and wherein said trough is inclined on its folding axis comprising a guide for conducting molten metal to a lowest point on said furnace floor.

7. In a method for melting pieces of copper in a furnace of the type having a refractory lined wall enclosing a melting chamber, a plurality of burners affixed in said wall for injecting heat into said copper pieces, and an outlet in the bottom of said chamber for continuously discharging molten copper, the improvement comprising:

(a) variably combining fuel and air in a plurality of mixing means remote from said burners;

(b) delivering said fuel and air mixture to said burners through a plurality of manifold means; and (c) burning said premixed combustible gaseous mixture of fuel and air in a plurality of refractory tunnel burners of the flame retention type affixed in the walls of said furnace wherein each of said burners includes a refractory tile combustion chamber of cylindrical cross section.

8. The method of claim 7 further comprising providing anti-back fire means by supplying more than one but no more than four burners by each manifold.

9. The method of claim 8 wherein only four burners are supplied with said premixed combustible gaseous mixture of fuel and air by each manifold.

10. The method of claim 7 wherein step (a) further comprises introducing fuel into an air supply equipped with venturi restriction means, proportioning said fuel and air prior to mixing, and monitoring said mixture proportions.

11. The method of claim 7 further comprising controlling melting chamber atmosphere by:

(a) calculating, for the fuel in use, the stochiometric fuel/air ratio;

(b) measuring the fuel/air ratio upstream of mixing means with orifice flow measuring means; and (c) adjusting the fuel/air ratio by varying said orifices until a mixture of 0.5 to 10 percent excess fuel over the stochiometric ratio is achieved thereby preventing oxidation of the metal being melted.

12. The method of claim 11 further comprising the step of continuously casting the melted copper into a solid product.

13. The method of claim 7 wherein step (c) further comprises washing the furnace floor clean of frozen copper and slag by placing the lower row of said burners such that the bottom edge of said combustion chamber is at or just above the furnace floor.

14. The apparatus of claim 13 wherein washing the furnace floor further comprises providing a "V" shaped trough in said furnace floor inclined on its folding axis for guiding molten metal to a lowest point on said furnace floor adjacent to an outlet.

15. A cast copper product produced by the method of claim 7 and characterized by absence of a deleterious level of oxygen contamination.

16. In a vertical shaft furnace for continuously melting and refining pieces of copper, said furnace being of the type having: a charge entrance opening near the top of the furnace, a vertical and generally cylindrical melting chamber enclosed by a refractory lined furnace wall, a plurality of burners opening through said wall for injecting hot combusted gas into said chamber to melt said copper pieces, and a tapping outlet in the bottom near the floor of said chamber for continuously discharging molten copper from said furnace, the improvement comprising:

a plurality of manifold means for supplying a premixed combustable gaseous fuel and air mixture to a plurality of burner means for combusting said mixture and injecting the hot combusted gas into said melting chamber, and wherein each burner further comprises a nozzle body inclined at a light angle from the horizontal and having a single entrance for receiving a gaseous fuel and air mixture from one of said plurality of manifolds, an interior nozzle lip adapted to retain a flame, a means for igniting said mixture located adjacent said lip, and a refractory combustion chamber tile attached to the nozzle body and communicating with the interior of the furnace.

17. The furnace of claim 16 wherein said plurality of manifolds each communicate with more than one but less than four burner means which are arranged in rows about the circumference of the furnace and at least one manifold feeds a lowermost row of burners which are located such that the bottoms of their refractory combustion chamber's tiles are just above the furnace floor thereby adapted to inject hot combusted gas across the floor to help wash molten copper out through the tapping outlet.

18. The furnace of claim 17 wherein there are three rows of burners, each of said rows being supplied by two manifolds arranged about the circumference of the furnace and wherein the first, lowermost, row has seven burners while the second and third rows each have eight burners.

* * * * *